US008118417B2

(12) United States Patent
Mantell

(10) Patent No.: US 8,118,417 B2
(45) Date of Patent: Feb. 21, 2012

(54) SYSTEM AND METHOD FOR PROCESSING SOLID INK STICK EXCEPTION CONDITIONS IN A SOLID INK PRINTER

(75) Inventor: David Allen Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 1021 days.

(21) Appl. No.: 12/043,806

(22) Filed: Mar. 6, 2008

(65) Prior Publication Data

US 2009/0225117 A1 Sep. 10, 2009

(51) Int. Cl.
*B41J 2/175* (2006.01)

(52) U.S. Cl. ..... 347/88; 347/5; 347/99

(58) Field of Classification Search ..... 347/5, 19, 347/88, 99, 14
See application file for complete search history.

(56) References Cited

U.S. PATENT DOCUMENTS

| | | | |
|---|---|---|---|
| 5,223,860 | A | 6/1993 | Loofbourow et al. |
| 5,442,387 | A | 8/1995 | Loofbourow et al. |
| 5,510,821 | A | 4/1996 | Jones et al. |
| 5,734,402 | A | 3/1998 | Rousseau et al. |
| 5,861,903 | A | 1/1999 | Crawford et al. |
| 6,056,394 | A | 5/2000 | Rousseau et al. |
| 6,543,867 | B1 | 4/2003 | Jones |
| 6,572,225 | B1 | 6/2003 | Jones |
| 6,679,591 | B2 | 1/2004 | Jones |
| 6,705,710 | B2 | 3/2004 | Reeves et al. |
| 6,709,094 | B2 | 3/2004 | Jones |
| 6,719,413 | B2 | 4/2004 | Jones |
| 6,722,764 | B2 | 4/2004 | Jones et al. |
| 6,893,121 | B2 | 5/2005 | Jones |
| 6,986,570 | B2 | 1/2006 | Jones et al. |
| 7,104,635 | B2 | 9/2006 | Jones |
| 7,780,284 | B2 * | 8/2010 | Fairchild et al. ..... 347/88 |
| 7,883,197 | B2 * | 2/2011 | Mantell et al. ..... 347/88 |
| 2007/0156628 | A1 * | 7/2007 | Rodriguez et al. ..... 707/1 |
| 2009/0153603 | A1 * | 6/2009 | Mantell ..... 347/7 |

* cited by examiner

*Primary Examiner* — Matthew Luu
*Assistant Examiner* — Rut Patel
(74) *Attorney, Agent, or Firm* — Maginot, Moore & Beck, LLP

(57) ABSTRACT

A system provides an operator of a solid ink stick printer method with information regarding solid ink stick exception conditions detected in a solid ink printer. The system includes a solid ink stick identifier that obtains identification data from a solid ink stick and that generates an ink stick ejection signal in response to detection of a solid ink stick exception condition, and a solid ink stick exception controller configured to generate a message for display in response to the ink stick ejection signal. obtaining solid ink stick identification data from a solid ink stick inserted into a solid ink printer, detecting a solid ink stick exception condition, generating an ink stick ejection signal in response to the detected solid ink stick exception condition, and generating a message for display in response to the ink stick ejection signal.

14 Claims, 7 Drawing Sheets

SYSTEM AND METHOD FOR PROCESSING SOLID INK STICK EXCEPTION CONDITIONS IN A SOLID INK PRINTER

TECHNICAL FIELD

The solid ink stick ejection system disclosed below generally relates to solid ink printers, and, more particularly, to solid ink printers having multiple feed channels for delivering different types of solid ink sticks to different melting devices.

BACKGROUND

Solid ink or phase change ink imaging devices, hereafter called solid ink printers, encompass various imaging devices, such as printers and multi-function devices. These printers offer many advantages over other types of image generating devices, such as laser and aqueous inkjet imaging devices. Solid ink or phase change ink printers conventionally receive ink in a solid form, either as pellets or as ink sticks. A color printer typically uses four colors of ink (yellow, cyan, magenta, and black).

The solid ink pellets or ink sticks, hereafter referred to as ink, sticks, or ink sticks, are delivered to a melting device, which is typically coupled to an ink loader, for conversion of the solid ink to a liquid. A typical ink loader includes multiple feed channels, one for each color of ink used in the imaging device. Each channel has an insertion opening in which ink sticks of a particular color are placed and then either gravity fed or urged by a conveyor or a spring-loaded pusher along the feed channel. Each feed channel directs the solid ink within the channel towards a melting device located at the end of the channel. Each melting device receives solid ink from the feed channel to which the melting device is connected and heats the solid ink impinging on it to convert the solid ink into liquid ink that is delivered to a print head for jetting onto a recording medium or intermediate transfer surface.

Each feed channel insertion opening may be covered by a key plate having a keyed opening. The keyed openings help ensure a printer user places ink sticks of the correct color in a feed channel. To accomplish this goal, each keyed opening has a unique shape. The ink sticks of the color corresponding to a particular feed channel have a shape corresponding to the shape of the keyed opening. The keyed openings and corresponding ink stick shapes exclude from each ink feed channel ink sticks of all colors except the ink sticks of the proper color for the feed channel. Unique keying shapes for other factors are also employed in keyed openings to exclude from a feed channel ink sticks that are formulated or intended for other printer models.

As the number of pages printed per minute increases for solid ink printers so does the demand for ink in the printer. To supply larger amounts of ink to printers, the cross-sectional area of the feed channels may be increased. Consequently, the insertion openings for the channels and the keyed plates covering the openings are likewise enlarged. These larger openings enable smaller solid ink sticks to pass through without engaging the keyed plates over the openings. Thus, solid ink sticks that do not conform to the appropriate color for a feed channel can be loaded into the feed channel and delivered to the melting device at the end of the feed channel. Even if the ink stick is the correct color, the stick may be include an ink formulation that has different chemical properties than those best suited for proper operation of the printer. In some situations, an ink stick may be the correct color for a feed channel and possess the chemical properties required for operation in the feed channel, but the size of the ink stick may impair the ability of the stick to cooperate with guiding structure within the feed channel.

To help ensure that each feed channel in a solid ink printer is loaded only with ink sticks configured for transport within the feed channel, systems have been developed that identify a solid ink stick before it is inserted in a feed channel. One such system provides a sensor at each ink stick insertion area for each feed channel in a solid ink printer. A mechanized barrier separates the insertion area from the feed channel. The barrier moves to enable an ink stick to enter the feed channel only in response to the ink stick being identified as one configured for transport through the feed channel. In another system that identifies ink sticks, an insertion port that is common to all of the feed channels is separated from the feed channels in a solid ink printer. A transport system moves an ink stick from the insertion port to its corresponding feed channel only in response to the ink stick being identified as one configured for the feed channel.

While these systems are effective for loading feed channels only with the ink sticks configured for a feed channel, they do not intelligently process ink sticks that do not correspond to a feed channel. For example, the system that uses a mechanized barrier to block the entrance to a feed channel simply remains in the blocking position in response to an ink stick failing the identification process. In order to enable the insertion port to process other ink sticks, the operator must physically remove the ink stick from the insertion port. Similarly, the system that uses the transport system to deliver an identified ink stick to its corresponding feed channel may leave an ink stick failing the identification process in the single insertion port. If the ink stick is left in the single insertion port, the operator must physically remove the ink stick from the single insertion port so another ink stick may be subjected to the identification process. Informing the operator of the reason for the rejection of the ink stick and providing the operator with options for dealing with the ink stick would be beneficial.

SUMMARY

A system provides an operator of a solid ink stick printer method with information regarding solid ink stick exception conditions detected in a solid ink printer. The system includes a solid ink stick identifier that obtains identification data from a solid ink stick and that generates an ink stick ejection signal in response to detection of a solid ink stick exception condition, and a solid ink stick exception controller configured to generate a message for display in response to the ink stick ejection signal.

A method of processing solid ink sticks loaded into a solid ink printer enables an operator to view information regarding solid ink stick exception conditions detected in the solid ink printer. The method includes obtaining solid ink stick identification data from a solid ink stick inserted into a solid ink printer, detecting a solid ink stick exception condition, generating an ink stick ejection signal in response to the detected solid ink stick exception condition, and generating a message for display in response to the ink stick ejection signal.

BRIEF DESCRIPTION OF THE DRAWINGS

Features for a system that processes solid ink sticks and responds to solid ink stick exception conditions that have been detected within a solid ink printer are discussed with reference to the drawings, in which.

DETAILED DESCRIPTION

Figure 1:
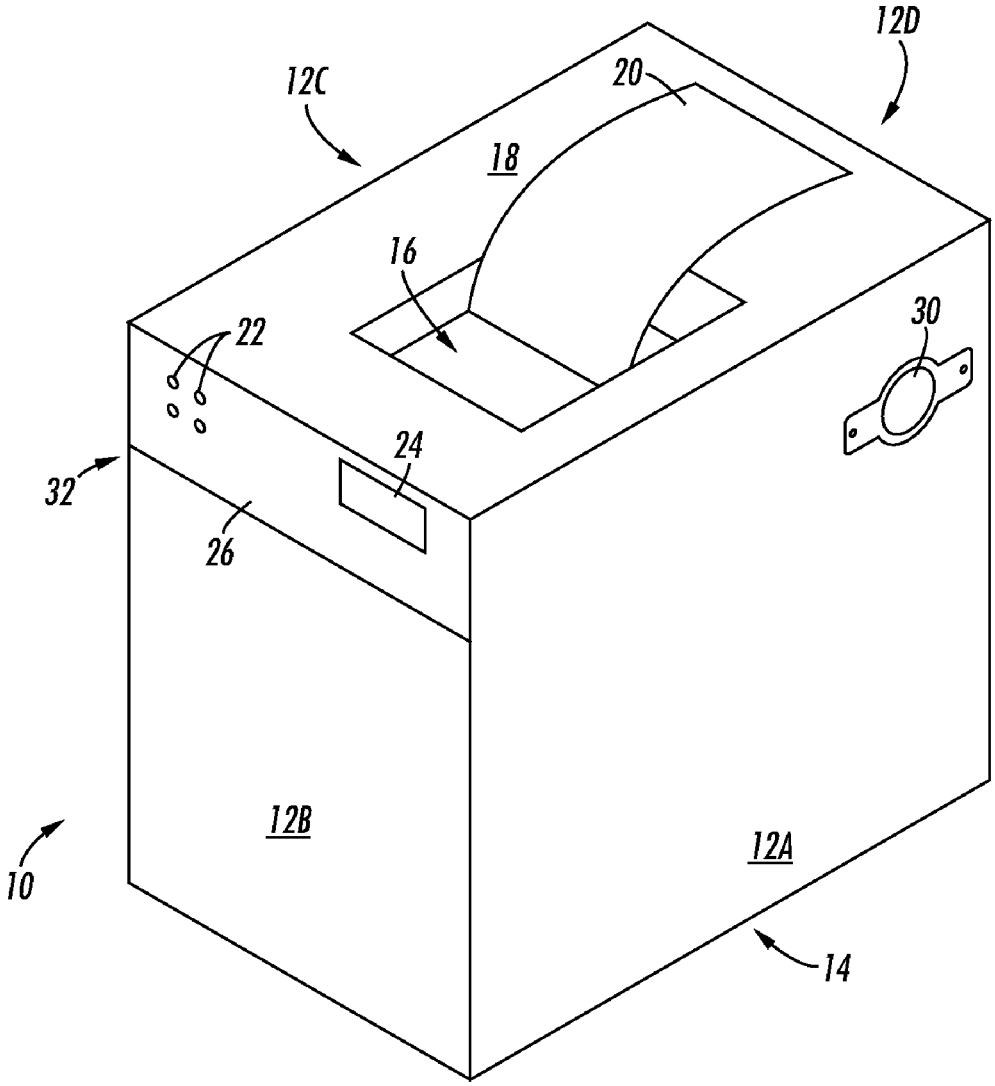
FIG. 1 is a perspective view of a solid ink printer having a single insertion port for receiving solid ink sticks.

The term "printer" refers, for example, to reproduction devices in general, such as printers, facsimile machines, copiers, and related multi-function products. An exemplary solid ink printer having a solid ink transport system that moves solid ink sticks from a single insertion port to a feed channel within the printer is shown in FIG. 1. The printer 10 includes a housing 32 having four vertically standing side walls 12A, 12B, 12C, and 12D, a bottom surface 14, and a top surface 18. Although the printer 10 is depicted in a shape that may be described a rectangular solid, other shapes are possible. Additionally, the surfaces of the housing need not be smooth, but may undulate or otherwise include depressions and protrusions to accommodate internal components or enhance the visibility of external features. The housing may also include a control panel 26 having a display 24 and one or more function keys 22 or other control actuators.

The upper surface 18 of the housing 32 may include, for example, an output tray 16. Recording media, such as a paper sheet 20, exit the housing 32 and rest in the output tray 16 until retrieved by a user or operator. The housing 32 may include a media supply tray (not shown) from which recording media may be removed and processed by the printer 10. While the output tray 16 is shown as being in the upper surface 18 of the housing 32, other positions are possible, such as extending from rear wall 12D or one of the other side walls.

As shown in FIG. 1, a single insertion port 30 may be provided in a side wall of the housing 32. Although the opening is depicted as being in the side wall 12A, it may be located in one of the other side walls or in the upper surface 18. In another embodiment, the housing 32 may include a hinged or other displaceable cover that may be opened to expose the single insertion port 30. Solid ink sticks are inserted into the port 30 by an operator. The port 30 is preferably configured to accept a range of different colors and types of solid ink sticks, although the opening may be sized to prevent some ink sticks from being inserted into the port 30. The port 30 is configured to accept different colors and different types of ink sticks because a sensor within the port obtains identification data from each ink stick inserted in the port. These data are compared to other data stored in the printer, as described in more detail below, to identify the ink sticks. The identified ink sticks are then moved to the feed channel within the printer that corresponds to the ink stick identification. Ink sticks not corresponding to the ink stick identification data may be moved to a location from which they may be easily removed from the printer and/or an indicator may be activated to notify the operator that an inappropriate ink stick has been loaded into the port and should be removed.

Figure 2:
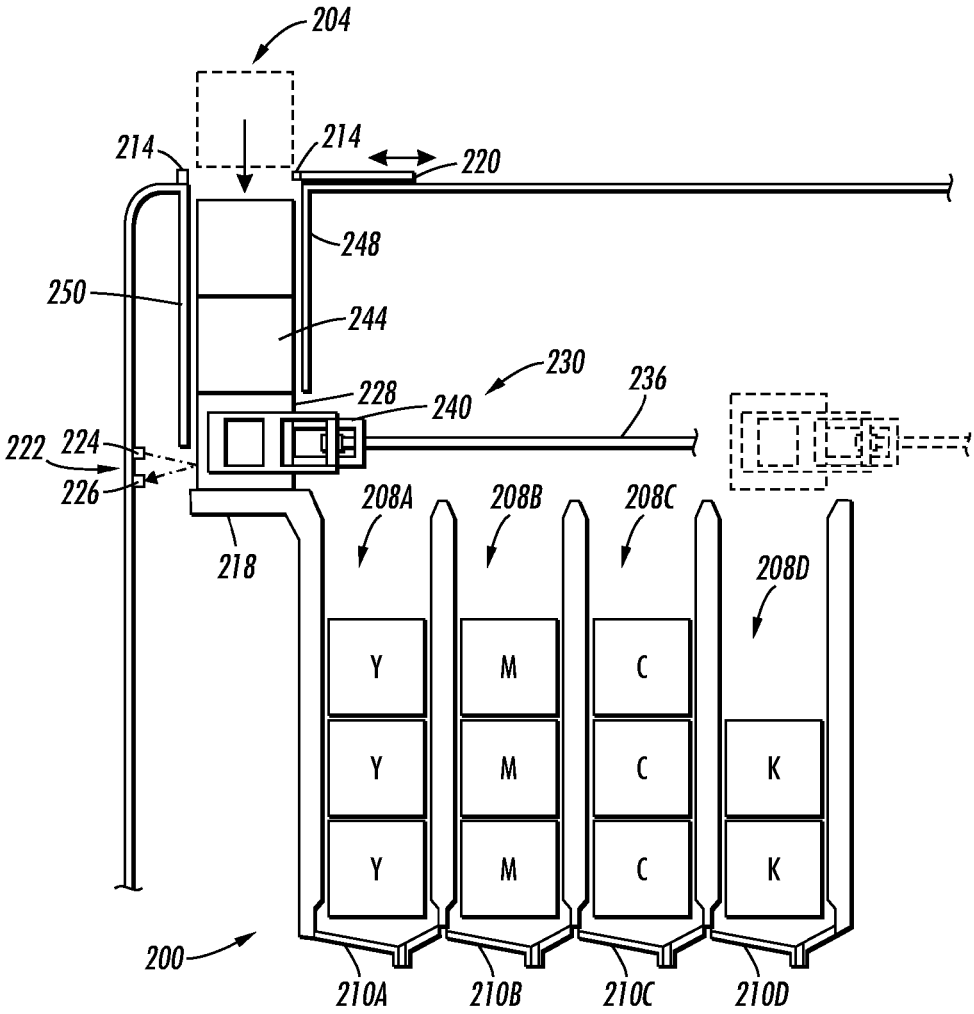
FIG. 2 is a front view of a system having a single ink insertion port for multiple feed channels.

An embodiment of a system for identifying and moving solid ink sticks inserted in a single insertion port is shown in FIG. 2. The system 200 includes a single insertion port 204 and four feed channels 208A, 208B, 208C, and 208D, which terminate in melt assemblies 210A, 210B, 210C, and 210D, respectively. The single insertion port 204 has a landing ledge 218. A cover 220 may be provided that is selectively displaceable with respect to the port 204. In one embodiment, moving the cover 220 to expose the port 204 generates a signal to activate the ink stick identification process. For example, contacts 214 may be configured on the housing and cover to generate a signal indicative of the state of the cover 220 for a processor (not shown) in the printer. As shown in FIG. 2, a sensor 222, which includes an optical source 224 and an optical detector 226, is proximate the landing ledge 218 so the sensor is enabled to obtain identification data from the ink stick on the landing ledge 218 and provide it to the processor in the printer. In the embodiment shown in FIG. 2, the optical source 224 illuminates the solid ink stick 228 resting on the ledge 218 and the optical detector 226 receives reflected light from the illuminated surface of the ink stick 228. In response to the reflected light, the optical detector generates an electrical signal corresponding to the identification data on the solid ink stick 228.

Figure 3:
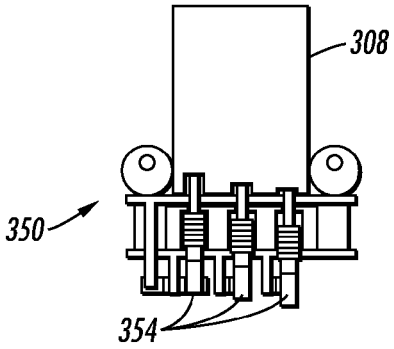
FIG. 3 depicts a single insertion port having a mechanical sensor for obtaining ink stick identification data from an ink stick placed in the port.

Although the discussion below relates to an optical sensor, a mechanical sensor that interacts with structural features of solid ink sticks may be used to generate an electrical signal indicative of the identification data for a solid ink stick. An example of such a mechanical sensor is shown in FIG. 3. The sensor 350 includes a plurality of spring biased actuators 354 that interact with the surface of an ink stick in an insertion port. The extension of the actuators interacting with the surface of the ink stick 308 is detected and used to generate an electrical signal corresponding to the ink stick identification data for the ink stick. This signal is provided to a processor for the ink stick identification process as described below.

To identify whether an ink stick corresponds to one of the feed channels in the printer 10, a processor within the printer receives the electrical signal from the sensor 222, which in the embodiment of FIG. 2 includes the optical detector 226, and compares the identification data obtained from the electrical signal to identification data for ink sticks stored in a memory of the printer. If the identification data obtained from the solid ink stick corresponds to stored identification data, the processor operates the ink stick transporter 230, as described more fully below, to move the ink stick to the feed channel corresponding to the identification data for the identified ink stick.

With further reference to FIG. 2, an ink stick transporter 230 moves an ink stick from the landing ledge 218 to one of the feed channels or to a reject area (not shown). The transporter 230 includes a drive mechanism 236 and a solid ink stick clamp 240. In response to the ink stick identification process, the processor performing the identification process activates the motive force for the drive mechanism 236 to move the clamp 240 towards the ink stick 228. The drive mechanism 236 may include a stepping motor or other electromechanical source of motive force that is coupled to a leadscrew or other traction drive to move the clamp 240. The clamp 240 is opened so the jaws of the clamp are placed about the ink stick 228 resting on the landing ledge 218 when the drive mechanism 236 reaches the end of its travel towards the landing ledge 218. In response to a signal from the processor indicating the identification process is complete, the jaws are clamped against the ink stick 228 and the drive mechanism is reversed. This operation removes the solid ink stick 228 from the landing ledge 218 and carries the solid ink stick in the jaws of the clamp 240 along a path that is above the feed channels 208A, 208B, 208C, and 208D. The next solid ink stick 244 drops onto the landing ledge 218 for the identification process. Guide walls 248 and 250 help keep the ink stick 244 in the correct orientation for the identification process as it drops onto the landing ledge. The processor stops the drive mechanism 236 when the stick in the clamp 240 has traveled a predetermined distance or time that corresponds to the location of the feed channel for the type of stick identified in the identification process. The clamp 240 is then opened to release the ink stick so it falls into the corresponding feed channel. Processing for those ink sticks not having identification data that corresponds to one of the feed channels is discussed more fully below.

Figure 4:
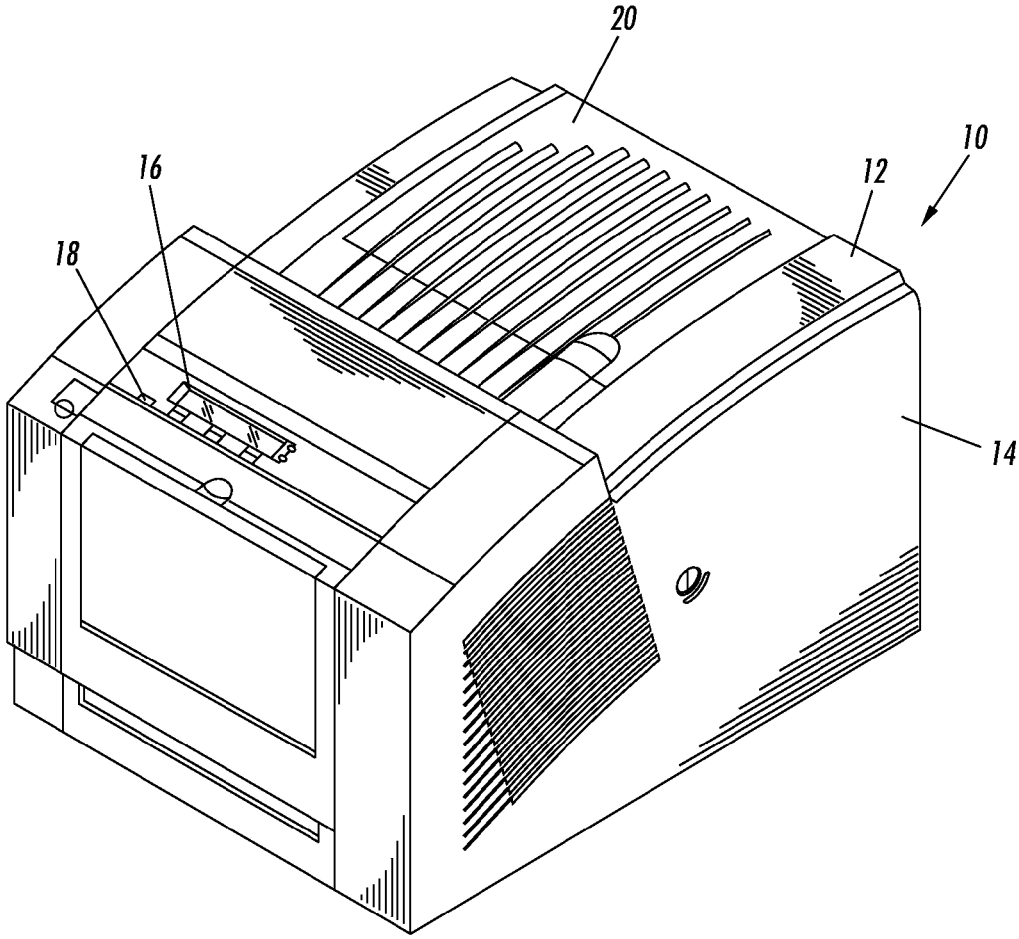
FIG. 4 PRIOR ART
FIG. 4 is a perspective view of a prior art solid ink printer having multiple feed channels with the printer top cover closed.

FIG. 4 shows an ink printer 410 that includes an outer housing having a top surface 412 and side surfaces 414. A user interface display, such as a front panel display screen 416, displays information concerning the status of the printer, and user instructions. Buttons 418 or other control actuators for controlling operation of the printer are adjacent the user interface window, or may be at other locations on the printer. An ink jet printing mechanism (not shown) is contained inside the housing. An ink feed system delivers ink to the printing mechanism. The ink feed system is contained under the top surface of the printer housing. The top surface of the housing includes a hinged ink access cover 420 that opens as shown in FIG. 5, to provide the user access to the ink feed system.

Figure 5:
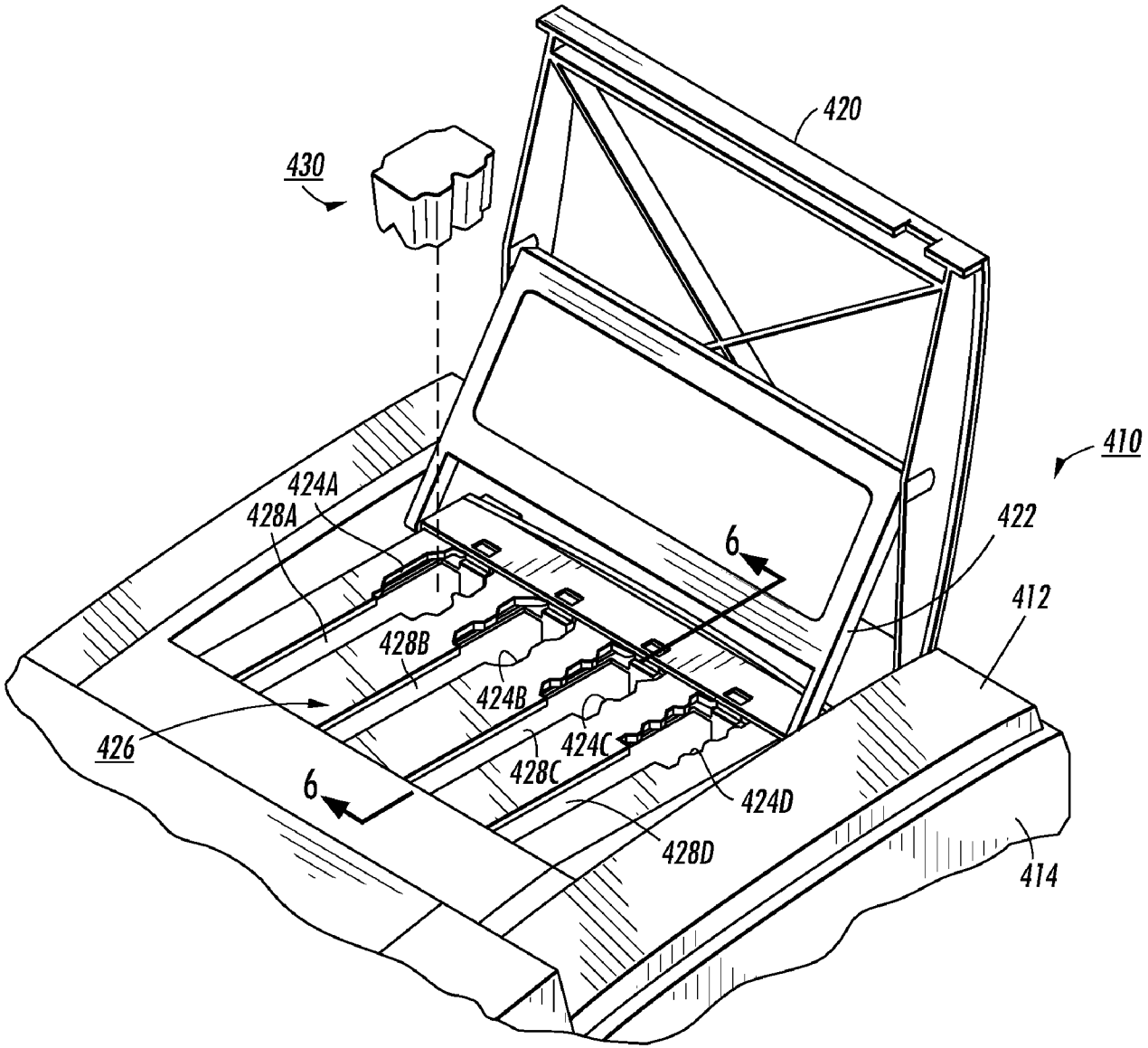
FIG. 5 PRIOR ART
FIG. 5 is a perspective view of the printer shown in FIG. 4 with the cover lifted to expose the multiple feed channels and the insertion port that each channel has for the insertion of solid ink sticks.

In the particular printer shown in FIG. 5, the ink access cover 420 is attached to an ink load linkage element 422 so that when the printer ink access cover 420 is raised, the ink load linkage 422 slides and pivots to an ink load position. The ink access cover and the ink load linkage element may operate as described in U.S. Pat. No. 5,861,903 for an Ink Feed System, issued Jan. 19, 1999 to Crawford et al. As seen in FIG. 5, opening the ink access cover reveals a key plate 426 having keyed openings 424A-D. Each keyed opening 424A, 424B, 4240, 424D provides access to an insertion end of one of several individual feed channels 428A, 428B, 428C, 428D of the solid ink feed system.

A color printer typically uses four colors of ink (yellow, cyan, magenta, and black). Ink sticks 430 of each color are delivered through a corresponding individual one of the feed channels 428A-D. The operator of the printer exercises care to avoid inserting ink sticks of one color into a feed channel for a different color. Ink sticks may be so saturated with color dye that it may be difficult for a printer user to tell by color alone which color is which. Cyan, and black ink sticks in particular can be difficult to distinguish visually based on color appearance. The key plate 426 has keyed openings 424A, 424B, 4240, 424D to aid the printer user in ensuring that only ink sticks of the proper color are inserted into each feed channel. Each keyed opening 424A, 424B, 4240, 424D of the key plate has a unique shape. The ink sticks 430 of the color for that feed channel have a shape corresponding to the shape of the keyed opening. The keyed openings and corresponding ink stick shapes exclude from each ink feed channel ink sticks of all colors except the ink sticks of the proper color for that feed channel. The feed channels of the prior art printer shown in FIG. 5 may be modified to have an ink stick identifier as described above with reference to FIG. 2. In this modification, the insertion area beneath each key plate opening includes one or more sensors that obtain identification data from each ink stick inserted in the port. These data are compared to other data stored in the printer to identify the ink sticks. Identification of an ink stick in the insertion port as corresponding to the feed channel coupled to the insertion area results in solid ink processing that is described in more detail below.

Figure 6:
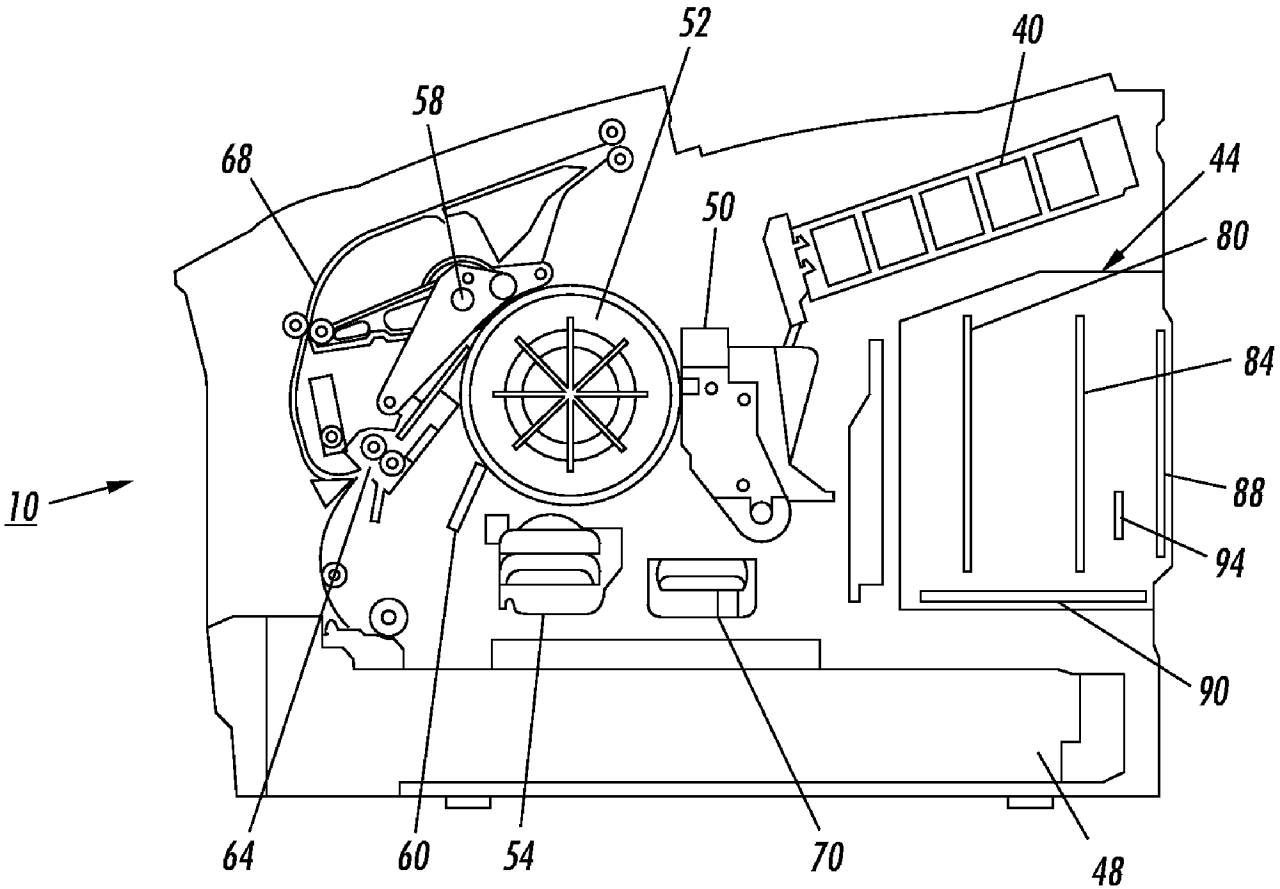
FIG. 6 PRIOR ART
FIG. 6 is a side view of the ink printer shown in FIG. 5 depicting the major subsystems of the ink printer.

As shown in FIG. 6, the ink printer 10 may include an ink loading subsystem 40, an electronics module 44, a paper/media tray 48, a print head 50, an intermediate imaging member 52, a drum maintenance subsystem 54, a transfer subsystem 58, a wiper subassembly 60, a paper/media preheater 64, a duplex print path 68, and an ink waste tray 70. In brief, solid ink sticks are loaded into ink loader 40 through which they travel to a melting device (not shown). At the melting device, the ink stick is melted and the liquid ink is diverted to a reservoir in the print head 50. The ink is ejected by piezoelectric elements through apertures in the print head 50 to form an image on the intermediate imaging member 52 as the member rotates. An intermediate imaging member heater is controlled by a controller to maintain the imaging member within an optimal temperature range for generating an ink image and transferring it to a sheet of recording media. A sheet of recording media is removed from the paper/media tray 48 and directed into the paper pre-heater 64 so the sheet of recording media is heated to a more optimal temperature for receiving the ink image. A synchronizer delivers the sheet of the recording media so its movement between the transfer roller in the transfer subsystem 58 and the intermediate image member 52 is coordinated for the transfer of the image from the imaging member to the sheet of recording media.

Figure 7:
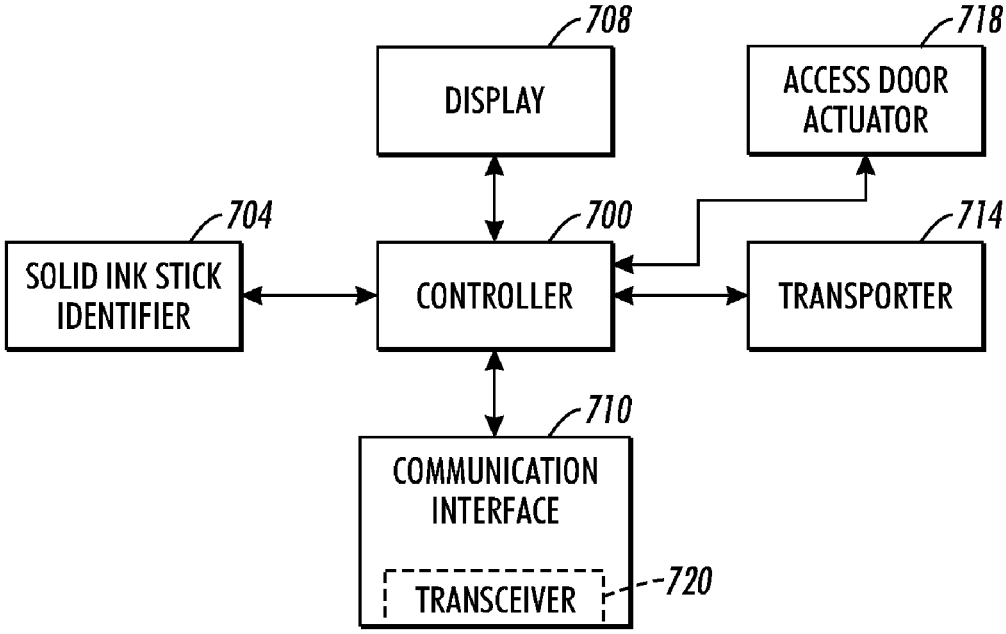
FIG. 7 is a block diagram of a system for processing a solid ink stick that cause solid ink exception conditions in a solid ink printer.

In both of the printers described above, a solid ink stick identifier is located in or near a loading area in which solid ink sticks are inserted, either for delivery to a feed channel or for release to the feed channel behind the loading area. Either type of printer may be configured with a system having a solid ink stick exception controller 700 as shown in FIG. 7. The solid ink stick exception controller 700 is coupled to a solid ink stick identifier 704, a display 708, and a communication interface 710 having a transceiver 720. The solid ink stick identifier 704 may be configured as described above. The controller 700 may be the controller that receives the identification data from the sensor of the identifier or it may be a separate controller, the controller for the printer, or a separate controller for implementing the exception processing of solid ink stick exception conditions detected in the printer. These solid ink stick exception conditions may refer to solid ink sticks that possess appropriate chemical qualities and the requisite physical configuration for use in a particular feed channel, but the feed channel may be unable to receive the ink stick. For example, the feed channel may be full. Alternatively, the solid ink stick exception conditions may be refer to detection of a chemical or physical parameter of the solid ink stick that does not suit the ink stick for proper use in the solid ink printer. Any of these controllers may be a general purpose processor having an associated memory in which programmed instructions are stored. Execution of the programmed instructions enables the controller to receive an ink stick ejection signal from the identifier that indicates a solid ink stick loaded into the printer has caused a solid ink stick exception condition to be detected, and to implement options for processing the solid ink stick exception condition. The controller may, alternatively, be an application specific integrated circuit or a group of electronic components configured on a printed circuit for operation of the identification and transport system. Thus, the controller may be implemented in hardware alone, software alone, or a combination of hardware and software.

The controller 700 is also coupled to the display 708 of the printer. The display 700 may be a liquid crystal display (LCD) or other known device capable of presenting alphanumeric data to a human operator. Associated with the display 708 are input data components, such as touch screen input, keypad, or button switches. These components enable an operator to respond to messages or menus to direct at least a portion of the exception processing performed by the controller 700. The controller 700 may also be coupled to an actuator, such as an electrical motor, to drive a transporter 714, such as an endless belt, in a direction to eject a solid ink stick from the loading area proximate the solid ink stick identifier 704. The loading area may also have an access door 718 that closes behind an ink stick placed in the loading area. The controller 700 generates electrical signals for an actuator driving the access door to open the door to receive an ink stick or to eject a solid ink stick from the loading area as described in more detail below.

The controller 700 may also be coupled to a communication interface 710 as shown in FIG. 7. The communication interface includes a transceiver 720. The communication interface may be a computer network communication card, which couples the printer to a wide area network (WAN), such as the Internet, through a wired or wireless router. The communication interface may, for example, be configured for socket session communications over a computer communication network. Alternatively or additionally, the communication interface may be a radio frequency transceiver or the like. The communication interface enables the controller 700 to communicate with one or more computers at one or more remote sites. The remote site computer may be operated by the printer manufacturer to obtain data about solid ink stick exception conditions, to arrange rebates or replacements for ink sticks causing solid ink stick exception conditions, or to enable the operator to continue with the use of ink sticks that have led to the detection of a solid ink stick exception condition after storage of that fact in the service record of the printer. To this end, operators at the remote site computers may monitor displays and interactively communicate with printer operators experiencing exception condition alerts as described below. In this manner, the manufacturer of the printer is able to warn the printer operator that an ink stick causing a solid ink stick exception condition has been loaded into a printer and that use of the ink stick may have consequences on the maintenance and operational costs of the printer.

In another embodiment, the communication interface and its transceiver 720 may also couple the printer to a local area network (LAN). In response to an ejection signal, the printer generates duplicates of the messages displayed on the printer for the printer operator or forwards duplicates of messages received from a remote site as described above. These messages may be delivered to another operator, sometimes referred to as a key operator. The key operator need not be present at the immediate site where the printer is located. Delivery of the messages may be accomplished with email, a web-based application, instant messaging, or the like. In order to preclude the acceptance of ink sticks that cause exception conditions from occurring too easily, the key operators may be the only persons having a password that enables the rejection of an ink stick to be overridden. In response to a message that indicates a password is required for acceptance of an ink stick being displayed to a key operator, the key operator may go to the printer to observe the ink stick and/or the printer and either enter the password to enable use of the ink stick or remove the ink stick from the printer. Alternatively or additionally, the key operator may call the local printer operator, discuss the condition leading to the ejection signal, and then remotely enter the password or direct the local operator to remove the ink stick. If a password is entered, the password is transmitted over the LAN to the printer where it is processed as described below to enable use of the ink stick that caused the ejection signal to be generated. This method of operation helps ensure responsibility and oversight in an organization for use of ink sticks that cause exception conditions.

Figure 8:
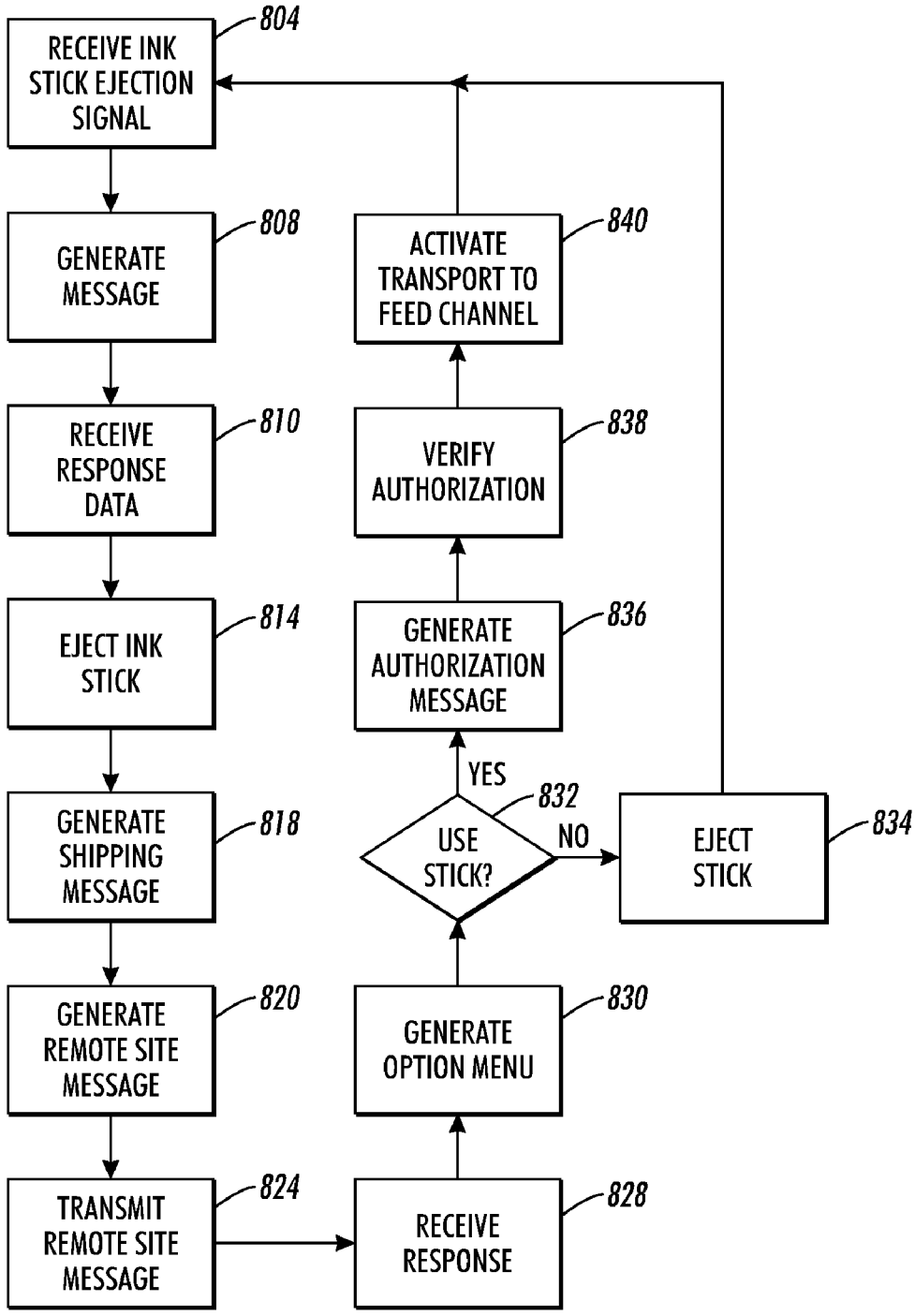
FIG. 8 is a flow diagram of a method for processing a solid ink stick that causes a solid ink exception condition in a solid ink printer.

The system of FIG. 7 may be used to implement a method of processing solid ink stick exception conditions in a solid ink printer. An exemplary method 800 is shown in FIG. 8. After the solid ink stick identifier obtains solid ink stick identification data from a solid ink stick inserted in the solid ink printer and generates a solid ink stick ejection signal in response to detection of a solid ink stick exception condition (block 804), a message is generated for display (block 808). The message alerts the operator that the ink stick loaded into the printer has caused an exception condition to be detected. The message may identify the solid ink stick exception condition with a textual message or it may provide an audible or visual signal, such as an annunciator beeping or a flashing LED. In some embodiments, an audible and/or a visual signal may be provided with the textual message. For example, the solid ink stick identification data obtained from the solid ink stick may not correspond to ink stick identification data stored in the printer. This lack of correspondence may indicate, for example, that the ink stick is a color that does not correspond to the ink color for the single feed channel coupled to the insertion area. In response, the message may indicate the ink stick is not the correct color and audible and visual indicators may accompany the textual message to alert the operator to this exception condition. The message may also identify the color of the ink stick so the operator knows which insertion area should receive the ink stick without generating an error message. In a printer having a single insertion port for multiple feed channels, the message may indicate that the ink stick does not correspond to any of the feed channels. If the ink stick has no identification data or has identification data not recognized by the processor implementing the identification process, the message may indicate that the source of the ink stick is not recognizable and may indicate that the stick is possibly damaged. Other ink stick exception condition messages may indicate the ink stick is for use in other printers manufactured by the manufacturer of the printer in which the ink stick has been loaded so the operator is able to place the ink stick in the correct printer. A sensor at a feed channel may generate a signal indicating the feed channel is full and this ink stick exception condition may result in a message being generated regarding that condition.

In response to the displayed message, the operator may enter a reject command or activate an actuator or touch screen area corresponding to a reject command. In response to receipt of responsive data (block 810), such as a reject command, the solid ink stick is ejected from the solid ink printer (block 814). Ejection of the ink stick may include, for example, opening an access door to the insertion area and operating a transporter on which the solid ink stick rests to extend a portion of the solid ink stick through the access door. Thus, the ink stick may be completely enclosed for the identification process and then an endless belt or other mechanized transporter may be activated to push, lift, or drop the ink stick to an ejection area where a portion of the ink stick is exposed. The exposed portion of the ink stick may then be grasped by the operator for removal from the printer.

Issues regarding the further handling of the rejected ink stick may also be addressed by the method 800. To that end, a shipping message may be displayed at the printer to identify a destination for return of the solid ink stick (block 818). This message may indicate to the operator that a replacement ink stick may be available from the manufacturer of the ink stick or it may indicate that upon return of the ink stick to the indicated address that the user receives a credit for future ink stick purchases. In this manner, the operator may ensure that only those ink sticks that are specifically configured for the printer to help ensure optimal operability of the printer. The returned ink stick is also useful to the ink stick manufacturer to ascertain any issues relating to degradation of ink stick identification data on ink sticks, for example, or other types of ink sticks, such as counterfeit ink sticks, that operators may consider equivalent to those for which the printer was designed to use.

As noted above, the printer may be coupled to a communication network to support communication between the printer and a remote site. The remote site may include a server that is coupled to a local area network (LAN) or a WAN operated for the ink stick manufacturer. In response to detection of a solid ink stick exception condition in the printer, the process 800 may also generate a message with the solid ink identification data obtained from the solid ink stick and identification data for the solid ink printer (block 820). The printer identification data enables the computer system(s) at the remote site to determine the type of ink stick identification data stored in the printer that was compared to the ink stick data on the ink stick. The generated message is transmitted to the site remote from the solid ink printer (block 824).

After processing the message from the printer, a computer system at the remote site may generate at least one message and transmit it to the printer. The responses of the remote computer(s) may be generated automatically or, as mentioned above, they may be generated by operators at the remote sites interacting with displays. The printer receives the message from the remote site (block 828), and may display an option menu identified in the received message (block 830). The option menu indicates to the operator alternative actions that may be taken with reference to the ink stick. For example, the option menu may enable the operator to use the ink stick in the printer after acknowledging warranty consequences or maintenance fees that may result from such action. Thus, the option menu may be used to inform an operator that use of the ink stick may result in charges for printer maintenance that would otherwise be covered under a maintenance contract, for example, because use of the ink stick causing the solid ink stick exception condition requires additional service tests, inspections, or the like. Alternatively or additionally, the controller may be configured to operate the printer to print a label with a return address to facilitate shipping of the ink stick to another location. This alternative or additional process may include communicating with a server connected to the LAN or WAN and automatically obtaining needed information for return of the ink stick, such as a return authorization number or shipping authorization for a particular package carrier.

If the selection of an option menu alternative has consequences on the printer warranty or maintenance (block 832), then an authorization message for selection of the option is generated (block 834). To verify authorization for a selection, the authorization message may include a password request. After the authorization is verified (block 838), with a password, for example, the solid ink stick is delivered to a feed channel in the solid ink printer in response to the received password corresponding to a password stored for the solid ink printer (block 840). If the menu selection indicated the ink stick is to be removed, the ink stick is ejected (block 834). After the ink stick has been moved to a feed channel for use in the printer or removed from the printer, the process continues to process the next ink stick loaded in the printer.

In embodiments in which an electrical motor is coupled to a movable drive, such as an auger, leadscrew, or push rod, the rotational output of the motor, which may be bidirectional, may be coupled to the movable drive through one or more gears. The gears may be used to adjust the speed of the linear movement of a pushrod or rotation of an auger. Additionally, the gears may be used to change the direction of the rotation input by the motor. The motors are coupled to a processor or other control component to receive electrical signals that enable the motors to be energized and control their speed as well as the direction of the motor output, if the motor is bidirectional.

Although the method 800 is described above in a serial manner, some portions of the method may be performed in different arrangements, sequences, or, in some cases, in a parallel manner. For example, the message identifying the ink stick and printer may be sent to the remote site for identification of an option menu before any message is displayed to an operator. In another embodiment, the message to the remote site may be sent in parallel to the display of messages to the operator. In another embodiment, the message enabling the operator to eject the ink stick may be a selection in an option menu.

In printers having a single insertion port, a single ink stick identifier is provided to identify all ink sticks loaded in the printer. The messages and options displayed inform the operator as to whether the ink stick is configured for use in any feed channel. In printers having an insertion area for each channel, a solid ink stick identifier is provided in each insertion area. Each ink stick identifier may be coupled to a single processor for implementing the system and method described above or each ink stick identifier may be coupled to a separate processor that executes the instructions for handling the ink sticks loaded into the insertion area for one feed channel only.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

I claim:

1. A system for processing solid ink stick exception conditions in a solid ink printer comprising:

a solid ink stick identifier that obtains identification data from a solid ink stick inserted into a solid ink printer and that generates an ink stick ejection signal in response to detection of a solid ink stick exception condition;

a controller configured to generate a message for display in response to the ink stick ejection signal and to display a shipping message to identify a destination for return of the solid ink stick; and a solid ink stick ejector configured to move the solid ink stick to a position for removal from the solid ink printer, the solid ink stick ejector being coupled to the controller to enable the solid ink stick ejector to be activated in response to an ejection command signal received from an operator interface of the solid ink printer.

2. The system of claim 1, the solid ink stick identifier being configured to generate the ink stick ejection signal in response to detection of a feed channel being unable to receive the solid ink stick from which the solid ink stick identifier obtained identification data.

3. The system of claim 1, the solid ink stick identifier being configured to generate the ink stick ejection signal in response to detection of the identification data obtained from the solid ink stick failing to correspond to ink stick identification data stored in the solid ink printer.

4. A system for processing solid ink stick exception conditions in a solid ink printer comprising:

a solid ink stick identifier that obtains identification data from a solid ink stick inserted into a solid ink printer and that generates an ink stick ejection signal in response to detection of a solid ink stick exception condition;

a controller configured to generate a message for display in response to the ink stick ejection signal and to generate a message with the solid ink identification data obtained from the solid ink stick and identification data for the solid ink printer; and a transmitter to transmit the generated message to a site remote from the solid ink printer.

5. The system of claim 4 further comprising:

a receiver to receive a message from the site remote from the solid ink printer; and the controller being further configured to display an option menu identified in the received message.

6. A system for processing solid ink stick exception conditions in a solid ink printer comprising:

a solid ink stick identifier that obtains identification data from a solid ink stick inserted into a solid ink printer and that generates an ink stick ejection signal in response to detection of a solid ink stick exception condition;

a controller configured to generate a message for display in response to the ink stick ejection signal and to operate the solid ink stick printer to print a label for return of the solid ink stick from which the solid ink stick identifier obtained identification data.

7. A system for processing solid ink stick exception conditions in a solid ink printer comprising:

a solid ink stick identifier that obtains identification data from a solid ink stick inserted into a solid ink printer and that generates an ink stick ejection signal in response to detection of a solid ink stick exception condition;

a controller configured to generate a message for display in response to the ink stick ejection signal and to display a password request to enable movement of the solid ink stick to a feed channel in the solid ink printer and to verify a password received in response to the displayed password request; and an override signal generator to reset the solid ink stick identifier to enable delivery of the solid ink stick to a feed channel in the solid ink printer in response to the received password corresponding to a password stored in the solid ink printer.

8. A method for processing solid ink stick exception conditions in a solid ink printer comprising:

obtaining solid ink stick identification data from a solid ink stick inserted into a solid ink printer;

detecting a solid ink stick exception condition;

generating an ink stick ejection signal in response to the detected solid ink stick exception condition; generating a message for display in response to the ink stick ejection signal;

moving the solid ink stick to a removal position to enable removal of the solid ink stick from the solid ink printer; and displaying a shipping message to identify a destination for return of the solid ink stick.

9. The method of claim 8, the solid ink stick exception condition detection further comprising:

detecting a feed channel inability to receive the solid ink stick from which the solid ink stick identification data was obtained.

10. The method of claim 8, the solid ink stick exception condition detection further comprising:

detecting the solid ink stick identification data obtained from the solid ink stick failing to correspond to ink stick identification data stored in the solid ink printer.

11. A method for processing solid ink stick exception conditions in a solid ink printer comprising:

obtaining solid ink stick identification data from a solid ink stick inserted into a solid ink printer;

detecting a solid ink stick exception condition;

generating an ink stick ejection signal in response to the detected solid ink stick exception condition;

generating a message with the solid ink stick identification data obtained from the solid ink stick and identification data for the solid ink printer;

displaying the generated message in response to the ink stick ejection signal; and transmitting the message to a site remote from the solid ink printer.

12. The method of claim 11 further comprising:

receiving a message from the site remote from the solid ink printer; and displaying an option menu identified in the received message.

13. A method for processing solid ink stick exception conditions in a solid ink printer comprising:

obtaining solid ink stick identification data from a solid ink stick inserted into a solid ink printer;

detecting a solid ink stick exception condition;

generating an ink stick ejection signal in response to the detected solid ink stick exception condition;

generating a message for display in response to the ink stick ejection signal; and printing a label for return of the solid ink stick from which the solid ink stick identification data was obtained.

14. A method for processing solid ink stick exception conditions in a solid ink printer comprising:

obtaining solid ink stick identification data from a solid ink stick inserted into a solid ink printer;

detecting a solid ink stick exception condition;

generating an ink stick ejection signal in response to the detected solid ink stick exception condition;

generating a message for display in response to the ink stick ejection signal;

displaying a password request to enable movement of the solid ink stick to a feed channel in the solid ink printer;

verifying a password received in response to the displayed password request; and delivering the solid ink stick to a feed channel in the solid ink printer in response to the received password corresponding to a password stored for the solid ink printer.

* * * * *